US008137885B2

(12) United States Patent
Kim et al.

(10) Patent No.: US 8,137,885 B2
(45) Date of Patent: Mar. 20, 2012

(54) HYBRID TONER AND METHOD OF PREPARING THE SAME

(75) Inventors: In Kim, Suwon-si (KR); Sang-deok Kim, Gwangmyeong-si (KR); Kyung-yol Yon, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1020 days.

(21) Appl. No.: 12/062,654

(22) Filed: Apr. 4, 2008 (Under 37 CFR 1.47)

(65) Prior Publication Data

US 2009/0023087 A1 Jan. 22, 2009

(30) Foreign Application Priority Data

Jul. 20, 2007 (KR) ..... 10-2007-0073120

(51) Int. Cl.
*G03G 9/08* (2006.01)

(52) U.S. Cl. ..... 430/110.1; 430/110.2; 430/110.3; 430/137.1; 430/137.11; 399/252

(58) Field of Classification Search ..... 430/110.1, 430/110.2, 110.3, 137.1, 137.11; 399/252
See application file for complete search history.

(56) References Cited

U.S. PATENT DOCUMENTS

2005/0208408 A1* 9/2005 Uchinokura et al. .... 430/108.21

* cited by examiner

*Primary Examiner* — Mark A Chapman
(74) *Attorney, Agent, or Firm* — Stanzione & Kim, LLP

(57) ABSTRACT

A hybrid toner includes micro cylinders, cores inserted into the micro cylinders, and an external addition layer covering the micro cylinders to which the cores are inserted. The hybrid toner prevents a toner blocking phenomenon, image contamination, and low storage stability which occur due to dispersion of wax and colorants to an outer surface of the toner.

14 Claims, 2 Drawing Sheets

HYBRID TONER AND METHOD OF PREPARING THE SAME

CROSS-REFERENCE TO RELATED APPLICATIONS

This application claims priority under 35 U.S.C. §119(a) from Korean Patent Application No. 10-2007-0073120, filed on Jul. 20, 2007, in the Korean Intellectual Property Office, the disclosure of which is incorporated herein in its entirety by reference.

BACKGROUND OF THE INVENTION

1. Field of the Invention

The present general inventive concept relates to a hybrid toner for an electrostatic electrophotographic development system and a method of fabricating the same, and more particularly, to a toner having a core-micro cylinder structure in which a core is inserted to a micro cylinder to prevent a toner blocking phenomenon, image contamination, and low storage stability which occur due to dispersion of wax or colorants to an outer surface of the toner, and a method of preparing the same.

2. Description of the Related Art

With respect to electrophotographic techniques or electrostatic recording techniques, developing agents which visualize an electrostatic image or an electrostatic latent image are categorized into 2-component developing agents which consist of a toner and carrier particles and 1-component developing agents which substantially consist of a toner alone, that is, does not use carrier particles. 1-component developing agents can be categorized into magnetic 1-component developing agents which include a magnetic component, and nonmagnetic 1-component developing agents which do not include a magnetic component. In general, a super plasticizer such as colloidal silica is independently added to a nonmagnetic 1-component developing agent to improve flowability of a toner. Generally, coloring particles obtained by dispersing a colorant such as carbon black or other additives in a binding resin are used in the toner.

Toner can be prepared using a pulverizing method or a polymerizing method. In a milling method, a synthesized resin, a colorant, and when required, other additives are melted, milled, and then sorted to obtain particles having desirable diameters, to thereby obtain a toner. However, due to characteristics illustrated when a toner is prepared using a dry milling method, when an amount of a wax is more than about 2.5 wt %, durability and storage stability of the toner may be degraded. Accordingly, the amount of the wax cannot be increased although a large amount of wax is required to prevent an offset phenomenon and improve fixing properties. In addition, when a toner is prepared using a milling method, a wax acting as an inner additive is required to be exposed in the milling process. Such exposing can cause toner blocking, and thus an image obtained from the toner may have defects and storage stability may be decreased.

Meanwhile, when a toner is prepared using a polymerizing method, a colorant, a polymerization initiator, and when required, other additives, such as a crosslinking agent or an antistatic agent, are uniformly dissolved in or dispersed into a polymerization monomer to prepare a polymerization monomer composition. Then, the polymerization monomer composition is dispersed into an aqueous dispersion medium including a dispersion stabilizer using a stirrer to form micro droplet particles of the polymerization monomer composition. Subsequently, the temperature is increased and then a suspension polymerization process is performed to obtain colored polymerization particles having desirable diameters, that is, a polymerization toner. For example, to prepare a toner, a core is formed using a vinyl-based monomer and an initiator, and then a vinyl-based monomer having hydrophilic properties equal to or greater than the core and a glass transition temperature (Tg) higher than the core is polymerized to form a shell. This method, however, requires a shell having a large thickness to obtain a clear core-shell structure and to improve preservation properties.

Specifically, with respect to electrophotographic copying machines, laser beam printers, and electrostatic recording apparatuses, in which images are formed using an electrophotographic technique or an electrostatic recording technique, a toner for developing an electrostatic image requires a low temperature fixing developing agent, corresponding to a high-speed device. Accordingly, there is a need to develop a developing agent which can be fixed at a low temperature.

SUMMARY OF THE INVENTION

The present general inventive concept provides a toner to develop an electrostatic image having good fixing properties and high storage stability at low temperature, which are obtained by preventing blocking and offsetting of a toner and improving fixing properties.

The present general inventive concept also provides a method of preparing the toner.

The present general inventive concept also provides an imaging method using a toner to enable formation of high quality images at low temperature.

The present general inventive concept also provides an imaging apparatus including a toner that can be fixed at low temperature and provides high quality images.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a hybrid toner including a micro cylinder, a core inserted to the micro cylinder, and an external addition layer covering the micro cylinder to which the core is inserted.

The foregoing and/or other aspects and utilities of the general inventive concept may also be achieved by providing a method of preparing a hybrid toner, the method including melting and mixing a vinyl-based resin and a colorant to prepare a micro cylinder forming molten product, melting and mixing a polyester-based resin, wax, a colorant, and a charge controller to prepare a core forming molten product which is to be inserted to the micro cylinder, extruding the micro cylinder forming molten product and the core forming molten product through a double extrusion micro-capillary die at the same time to prepare a core-micro cylinder in which the core is inserted to the micro cylinder, milling the core-micro cylinder, and covering the milled core-micro cylinder with an external addition layer including silica, metal oxide, and a polymer bead.

The foregoing and/or other aspects and utilities of the general inventive concept may also be achieved by providing an imaging method including forming a viable image by attaching hybrid toner to a surface of a photoreceptor on which a latent image is formed, and transferring a visible image onto a transferring sheet, and wherein the hybrid toner includes a micro cylinder, a core inserted into the micro cylinder and an external addition layer covering the micro cylinder into which the core is inserted.

The foregoing and/or other aspects and utilities of the general inventive concept may also be achieved by providing an imaging apparatus including an organic photoreceptor, a unit to charge a surface of the organic photoreceptor, a unit to form a latent image on the surface of the organic photoreceptor, a unit which to receive hybrid toner, a unit to supply the hybrid toner to develop the latent image formed on the surface of the organic photoreceptor so as to develop a toner image, and a unit to transfer the toner image from the surface of the photoreceptor to a transferring sheet, and wherein the hybrid toner includes a micro cylinder, a core inserted into the micro cylinder and an external addition layer covering the micro cylinder into which the core is inserted.

The foregoing and/or other aspects and utilities of the general inventive concept may also be achieved by providing an apparatus to prepare a hybrid toner, the apparatus including a first extruder to extrude a core, a second extruder to extrude a micro cylinder, and double extrusion capillary die through which the core and the micro cylinder are extruded at a same time, wherein the core is disposed in the micro cylinder.

The first and second extruders may include extruder modular co-rotating twin screw extruders having a plurality of kneading blocks.

The first extruder may extrude the core at a supply speed of 1.5 kg/hr at a screw speed of 150 rpm at an inside temperature thereof in a range from 120° C. to 125° C.

The second extruder may extrude the micro cylinder at a supply speed of 1.8 kg/hr at a screw speed of 150 rpm at an inside temperature thereof in a range from 110° C. to 115° C.

The foregoing and/or other aspects and utilities of the general inventive concept may also be achieved by providing a method to prepare a hybrid toner, the method including extruding a core through a double extrusion capillary die by a first extruder, and extruding a micro cylinder through the double extrusion capillary die by a second extruder at a same time as the extruding of the core so that the core is disposed in the micro cylinder.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
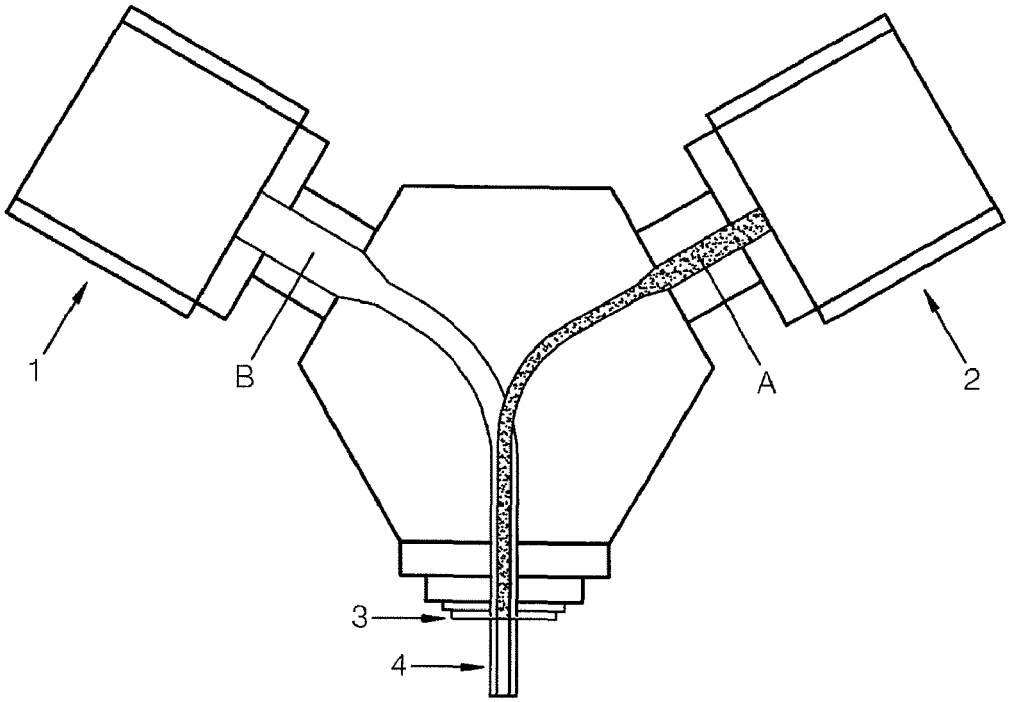
FIG. 1 is a schematic view of a double extruder used in a method of preparing a hybrid toner according to an embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

A hybrid toner according to an embodiment of the present general inventive concept can be fixed at a low temperature and has high storage stability, which is obtained by preventing blocking and offset of a toner and improving fixing properties. The hybrid toner is used to develop electrostatic images which are formed in electrophotographic copying machines, laser beam printers, and electrostatic recording apparatuses, using an electrophotographic technique or an electrostatic recording technique.

The hybrid toner according to the present embodiment includes a core formed of a polyester-based resin. Due to use of the polyester-based resin as a core, low temperature fixing properties and glossing properties suitable for a graphic printing technique can be obtained. The core is inserted into a hollow of a micro cylinder formed of a vinyl-based resin, so that toner particles can obtain good preservation properties and high charging properties.

The polyester-based resin included in the core includes an acid component and an alcohol component. Alternatively, the polyester-based resin can be a blend of one or two types of resin which are particulate. The equivalent ratio of the acid component to the alcohol component may be in a range from 1:1 to 1:2.

The acid component can be an aromatic dibasic acid component, a three or more-valent polyfunctional acid component, or a sulfonic acid-containing aromatic dibasic acid component.

The aromatic dibasic acid component can include an aromatic dibasic acid which is used in a conventional method of preparing a polyester resin, and/or an alkyl ester thereof. The aromatic dibasic acid can be telephthalic acid or isophthalic acid. The alkyl ester of the aromatic dibasic acid can be dimethyltelephthalate, dimethylisophthalate, diethyltelephthalate, diethylisophthalate, dibutyltelephthalate, or dibutylisophthalate. The aromatic dibasic acid and the alkyl ester thereof can be used alone or in a combination of at least two materials selected from the aromatic dibasic acid and the alkyl ester thereof.

The three or more-valent polyfunctional acid component can be, but is not limited to, trimellitic acid, pyromellitic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,2,7,8-octanetetra carboxylic acid, the alkyl ester and/or acid anhydride thereof.

Among acid components described above, the sulfuric acid-containing aromatic dibasic acid component improves dispersibility of a colorant of the toner and a charge controlling capability of a charge controlling agent, and thus printed images of high quality can be obtained. For example, the sulfonic acid-containing aromatic dibasic acid component can be dimethyl 5-sulfoisophthalate sodium salt, 5-sulfoisophthalic sodium salt, or a mixture thereof.

The alcohol component of the polyester resin for a toner according to the present embodiment includes an aliphatic diol, specifically 1,2-propandiol. The aliphatic diol can be 1,2-propandiol, ethyleneglycol, diethyleneglycol, neophentylglycol, or 1,4-butandiol. Specifically, use of 1,2-propandiol is desired because reactivity can be easily controlled when a polyester resin is polymerized.

The softening point of the polyester-based resin may be in a range from 90 to 170° C., and specifically, from 99 to 135° C. When the softening point of the polyester-based resin is less than 90° C., durability and preservation stability of the toner may be decreased. Alternatively, when the softening point of the polyester-based resin is higher than 170° C., excellent glossing properties and excellent fixing properties cannot be obtained.

The number average molecular weight of the polyester-based resin may be in a range from 1,000 to 120,000, and specifically, from 5,000 to 50,000. When the number average molecular weight of the polyester-based resin is less than 1,000, durability of the toner can be decreased. Alternatively, when the number average molecular weight of the polyester-based resin is more than 120,000, fixing properties of the toner may be decreased.

The polyester-based resin described above can be used together with one or more inner additive selected from the group consisting of wax, a releasing agent, a colorant, and a charge controller to form a core.

The type of wax contained in the core of the toner is determined according to purposes of the toner. An available wax can be, but is not limited to, polyethylene-based wax, polypropylene-based wax, silicon wax, paraffin-based wax, ester-based wax, carnauba wax, or metallocene wax.

A melting point of the wax in the toner according to the present embodiment may be in a range from about 50° C. to about 150° C., since a wax having the melting point of this range can secure effective releasing properties. The higher the melting point is of the wax, the lower is the dispersibility of the toner. Alternatively, when the melting point of the wax is lower, dispersibility of the toner is increased. However, in consideration of environmental factors in an electrophotographic device using the toner and fixing properties of a final printed image, the suitable melting point of the wax may be in a range from about 50° C. to about 150° C. The wax may be physically close to a toner particle, but may not be covalently bonded to the toner particle. Thus, a toner including such a wax can be fixed on a final image receptor at low temperature and a final image obtained from the toner can have excellent image durability and wear resistance.

The amount of the wax in the toner may be in a range from 1 to 20 parts by weight, and specifically, 1 to 10 parts by weight, based on 100 parts by weight of the polyester-based resin. When the amount of the wax is less than 1 part by weight, releasing properties of the toner may be decreased. Alternatively, when the amount of the wax is more than 20 parts by weight, durability of the toner may be decreased.

A releasing agent which is added to the core of the toner can be appropriately used to protect a photoreceptor and to prevent degradation of developing properties to obtain high quality images. A releasing agent according to an embodiment of the present general inventive concept can be a high-purity solid aliphatic acid ester-based material. The releasing agent can be a low molecular weight polyolefin, such as low molecular weight polyethylene, low molecular weight polypropylene, or low molecular weight polybutylene; paraffine wax; or a multifunctional ester compound. For example, the releasing agent can be a multifunctional ester compound including a three or more functional alcohol and a carboxylic acid. The amount of the releasing agent may be in a range from 0.1 to 10 parts by weight based on 100 parts by weight of the polyester-based resin. When the amount of the releasing agent is more than 10 parts by weight, durability of the toner may be decreased. Alternatively, when the amount of the releasing agent is less than 0.1 parts by weight, releasing properties of the toner may be degraded.

A charge controller which is added to the core of the toner may be selected from the group consisting of a salicylic acid compound containing metal, such as zinc or aluminum; a boron complex of bis diphenyl glycolic acid, and silicate. Specifically, the charge controller can be a zinc dialkyl salicylic acid or a boro bis(1,1-diphenyl-1-oxo-acetyl potassium salt). An amount of the charge controller in the core may be in a range from 0.1 to 10 parts by weight, and specifically, from 1 to 3 parts by weight based on 100 parts by weight of the polyester-based resin. When the amount of the charge controller is less than 0.1 parts by weight, charging properties may be reduced. Alternatively, when the amount of the charge controller is greater than 10 parts by weight, excess charging occurs and thus problems may occur when a developing process is performed.

A colorant which is added to the core of the toner can be carbon black or an aniline black, in the case of black toner. The hybrid toner according to an embodiment of the present general inventive concept is suitable for a color toner. Meanwhile, in the case of a color toner, the colorant can include carbon black to provide black; and yellow, magenta, and cyan colorants to provide color.

The yellow colorant can be a condensation nitrogen compound, isoindolinone compound, an anthraquine compound, an azo metal complex, or an allyl imide compound. Specifically, examples of the yellow colorant can include C.I. pigment yellows 12, 13, 14, 17, 62, 74, 83, 93, 94, 95, 109, 110, 111, 128, 129, 147, 168, and 180.

The magenta colorant can be a condensation nitrogen compound, anthraquine, a quinacridone compound, a base dye rate compound, a naphthol compound, benzo imidazole compound, a thioindigo compound, or a perylene compound. Specifically, examples of the magenta colorant can include C.I. pigment reds 2, 3, 5, 6, 7, 23, 48:2, 48:3, 48:4, 57:1, 81:1, 122, 144, 146, 166, 169, 177, 184, 185, 202, 206, 220, 221, and 254.

The cyan colorant can be a copper phthalocyanine compound and a derivative thereof, an anthraquine compound, or a base dye rate compound. Specifically, examples of the cyan colorant can include C.I. pigment blues 1, 7, 15, 15:1, 15:2, 15:3, 15:4, 60, 62, and 66.

These colorants described above can be used alone or in combination in consideration of the color, chroma, black and white properties of the toner, and weather resistance and dispersibility properties of the toner.

The respective colorant may have such an amount that the toner is sufficiently colored. For example, the amount of the colorant may be in a range from 0.1 to 10 parts by weight, and specifically, 2 to 6 parts by weight, based on 100 parts by weight of the polyester-based resin. When the amount of the colorant is less than 0.1 parts by weight, a sufficient coloring effect cannot be obtained. Alternatively, when the amount of the colorant is greater than 10 parts by weight, manufacturing costs of the toner may be increased, and a sufficient friction charge cannot be obtained.

Micro cylinders including a vinyl-based resin to which the cores are to be inserted are formed to form a hybrid toner having a core-micro cylinder structure.

The vinyl-based resin which forms the micro cylinder can be a polymer containing one or more repeat units selected from the group consisting of a styrene-based repeating unit, such as styrene, vinyltoluene, or α-methylstyrene; a (meth) acrylate-based repeating unit, such as (meth)acrylate, methyl (meth)acrylate, ethyl(meth)acrylate, propyl(meth)acrylate, butyl(meth)acrylate, 2-ethyl hexyl(meth)acrylate, dimethylaminoethyl(meth)acrylate, (meth)acrylonitrile, or (meth) acrylamide; an ethylene unsaturated monoolefine-based repeating unit, such as ethylene, propylene, or butylene; a vinyl halide-based repeating unit, such as vinyl chloride, vinylidene chloride, or vinyl fluoride; a vinylester-based repeating unit, such as vinyl acetic acid or vinyl propionic acid; a vinylether-based repeating unit, such as vinylmethylether or vinylethylether; a vinylketone-based repeating unit, such as vinylmethylketone or methylisoprophenylketone; and a nitrogen-containing vinyl-based repeating unit, such as 2-vinylpyridine, 4-vinylpyridine, or N-vinylpyrrolidone, or a mixture of two types of the polymers described above.

The glass transition temperature of the vinyl-based resin may be in a range from 50 to 80° C., and specifically, from 55 to 61° C. When the glass transition temperature of the vinyl-based resin is less than 50° C., preservation properties and durability may be degraded. Alternatively, when the glass transition temperature of the vinyl-based resin is more than 80° C., milling and fixing properties of the toner may be degraded.

An amount of the vinyl-based resin may be appropriately determined depending on an amount of the core. For example, the amount of the vinyl-based resin may be in a range from 5 to 500 parts by weight, and specifically, from 100 to 250 parts by weight, based on 100 parts by weight of the polyester-based resin. When the amount of the vinyl-based resin is less than 5 parts by weight, the micro cylinder is insufficiently formed. Alternatively, when the amount of the vinyl-based resin is more than 500 parts by weight, the micro cylinder becomes too thick.

An external addition layer to cover the micro cylinders to which the cores are inserted can include an external additive, such as silica, metal oxide, or a polymer bead.

An amount of the silica may be in a range from 0.1 to 10 parts by weight, and specifically, from 0.5 to 2.0 parts by weight, based on 100 parts by weight of the polyester-based resin. When the amount of the silica is less than 0.1 parts by weight, flowability of the toner may be reduced. Alternatively, when the amount of the silica is greater than 10 parts by weight, image contamination and development defects may occur.

Such a silica is usually used as a dehumidifying agent, but a function thereof may differ according to a particle size thereof. When a size of a primary particle of silica is in a range from about 30 nm to about 200 nm, such silica is called as a large silica particle. When a size of the primary particle of silica is in a range from about 5 nm to 20 nm, such silica is called a small silica particle.

The terminology "primary particle" used herein refers to a particle unit of a compound which has not been subjected to a polymerization or binding process. In general, small silica particles are added to improve flowability of toner particles, and large silica particles are added to provide charging properties to toner particles. The silica that acts as the external additive may include small silica particles and large silica particles in an appropriate ratio. For example, the amount of small silica particles having a primary particle size from 5 nm to 20 nm may be in a range from 0.05 parts by weight to 5 parts by weight based on 100 parts by weight of the polyester-based resin, and an amount of large silica particles having a primary particle size from 30 nm to 200 nm may be in a range from 0.05 parts by weight to 5 parts by weight based on 100 parts by weight of the polyester-based resin.

A size of primary particles of small silica particle and large silica particle which are added to the external addition layer may be determined in consideration of availability with respect to toner particles and sizes of toner particles.

When a total amount of the silica that functions as the external additive is less than 0.1 parts by weight based on 100 parts by weight of the polyester-based resin, an improvement in flowability and charging ability of the toner due to addition of silica cannot be obtained. Alternatively, when the amount of the total silica is greater than 10 parts by weight based on 100 parts by weight of the polyester-based resin, the toner has an excess charging ability, so that the charge applied to toner particles cannot be controlled. Accordingly, such information should be considered to determine an appropriate amount of the total silica.

The metal oxide that functions as the external additive may include titanium oxide. The amount of titan oxide may be in a range from 0.1 parts by weight to 5 parts by weight, and specifically, from 0.5 to 2.0 parts by weight, based on 100 parts by weight of the polyester-based resin. The titan oxide can exist having various acid values, in addition to the form of $TiO_2$ which is generally used. The titan oxide is dissolved in alkali to form titanic acid alkali. The titan oxide is usually used as a white pigment (titan white) having high coverage properties, and can be used in ceramic sources, abrasives, pharmaceutical products, and cosmetic products. The titan oxide can control excess charges which may be caused when the external additive used according to an embodiment of the present general inventive concept includes titan oxide alone. The titan oxide used in the present embodiment may be surface-treated with alumina and organo polysiloxane. The primary particle of the titan oxide may be in a range from 10 to 200 nm. Like silica, a diameter of titan oxide may be determined in consideration of sizes of toner particles and availability with respect to the toner. The surface-treated titan oxide may have a BET surface area from 20 $m^2/g$ to 100 $m^2/g$.

The external addition layer of the hybrid toner may further include, in addition to metal oxide and silica, a polymer bead. The polymer bead may be selected from the group consisting of a styrene-based resin, methyl methacrylic acid, styrene-methyl methacrylic acid copolymer, an acryl-based resin, an acryl-styrene copolymer, and a combination thereof. Such a resin bead has a spherical shape because the resin bead is prepared through a polymerization process, such as a suspension polymerization process. A size of the resin bead may be in a range from submicrons to a few micron. An amount of the polymer bead which is added to the external addition layer may be in a range from 0.1 to 10 parts by weight, and specifically, from 0.2 to 2 parts by weight, based on 100 parts by weight of the polyester-based resin. When the amount of the polymer bead is less than 0.1 parts by weight, charging properties may be decreased. Alternatively, when the amount of the polymer bead is more than 10 parts by weight, image contamination may occur.

In addition to inner and external additives described above, the hybrid toner according to the present embodiment may further include various other internal or external additives to improve functions of the hybrid toner. For example, the hybrid toner may further include as an internal or external additive an agent selected from the group consisting of a UV stabilizer, an antibacterial agent, bacteriocide, fungicide, an antistatic agent, gloss modifier, antioxidant, an antisetting agent such as a silane or silicon-modified silica particle, and a combination thereof. An amount of the internal or external additive described above may be in a range from 0.1 to 10 parts by weight based on 100 parts by weight of the polyester-based resin.

The hybrid toner according to the present embodiment described above may have an average diameter from 4.0 to 12.0 μm, and specifically, from 5.0 to 9.0 μm. When the average diameter of the hybrid toner is less than 4.0 μm, cleaning an organic photoconducting cartridge (OPC) is difficult and the production yield may be decreased. Alternatively, when the average diameter of the hybrid toner is more than 12.0 μm, uniform charging may occur, fixability of the toner may be decreased, and a Dr-blade cannot control a toner layer.

A method of preparing the hybrid toner according to the present embodiment described above will now be described in detail.

The method of preparing the hybrid toner according to the present embodiment may include melting and mixing a vinyl-based resin and a colorant to prepare a micro cylinder forming molten product; melting and mixing a polyester-based resin, wax, a colorant, and a charge controller to prepare a core forming molten product which is to be inserted to micro cylinders formed by the micro cylinder forming molten product; extruding the micro cylinder forming molten product and the core forming molten product at the same time through a double extrusion micro-capillary die to prepare a core-micro cylinder in which the core is inserted in the micro cylinder; milling the core-micro cylinder; and covering the milled core-micro cylinder with an external addition layer including silica, metal oxide, and polymer beads.

In the method described above, respective components used, such as a polyester-based resin, wax, a colorant, a charge controller, a polymerization monomer, silica, metal oxide, a polymer bead etc. may be used in a content ratio described above.

The extruding process can be performed using a double extruder including a micro capillary die.

FIG. 1 is a view illustrating a double extruder used in the method of preparing hybrid toner according to an embodiment of the present general inventive concept. The double extruder includes a first extruder 1 to prepare and extrude a core forming molten product A and a second extruder 2 which prepares and extrudes a micro cylinder forming molten product B, in which the second extruder 2 is connected to the first extruder 1 by a micro capillary die 3. Such a double extruder is used to prepare a core-micro cylinder 4.

Figure 2:
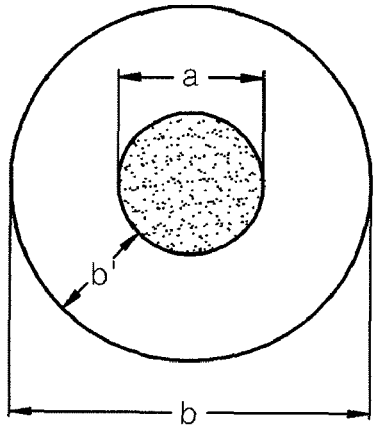
FIG. 2 is a schematic view illustrating a capillary die of a double extruder used in a method of preparing a hybrid toner according to an embodiment of the present general inventive concept.

FIG. 2 is a schematic view illustrating a capillary die of a double extruder. Referring to FIGS. 1 and 2, a portion of the capillary die connected to the first extruder 1 may have a diameter a in a range from 4 to 10.9 μm, and specifically, from 5.0 to 9.0 μm; and a portion of the capillary die connected to the second extruder 2 may have a diameter b in a range from 5 to 11 μm, and specifically, 5.2 to 10.0 μm. Accordingly, a portion of the capillary die through which the micro cylinder forming molten product B is extruded may have a thickness b' in a range from 0.1 to 1.0 μm, and specifically, 0.1 to 0.5.

When the core-micro cylinder 4 in which a core is inserted into a micro cylinder is formed using the double extruder, a supply speed, a screw speed, and a melting point in the double extruder should be carefully controlled.

The supply speed may be in a range from 0.5 to 5.0 kg/hr, and specifically, from 1.0 to 2.0 kg/hr. When the supply speed is less than 0.5 kg/hr, time spent in the double extruder is too large, so that flowability may be reduced. Alternatively, when the supply speed is more than 5.0 kg/hr, the time spent in the double extruder is too small, so that flowability cannot be controlled.

The screw speed may be in a range from 50 to 400 rpm, and specifically, from 150 to 200 rpm. When the screw speed is less than 50 rpm, difference between viscosity of the core forming molten product A and viscosity of the micro cylinder forming molten product B is large so that the core-micro cylinder 4 structure cannot be obtained. Alternatively, when the screw sped is more than 400 rpm, the difference between the viscosity of a core forming molten product and the viscosity of a micro cylinder forming molten product is large so that the core-micro cylinder structure cannot be obtained.

A temperature in the first and second extruders 1 and 2 may be in a range from 100 to 200° C., and specifically, from 110 to 150° C. When the temperature in the first and second extruders 1 and 2 is lower than 100° C., the shear force of the first and second extruders is too large so that the binder resin cannot be processed, and even when the binder resin is processed, homogeneous mixing cannot be obtained. Alternatively, when the temperature is higher than 150° C., the viscosity of the molten product is too low so that flowability is low and the core-micro cylinder 4 structure according to the present embodiment cannot be obtained.

Then, the core-micro cylinder 4 prepared is milled. The milling process can be performed twice. First, the core-micro cylinder 4 is milled into particles having a particle size of a few mm. Then, the obtained particles are then milled into particles having a particle size of a few to tens μm. Thus, the milled core-micro cylinder is sorted to obtain microparticles having a particle size in a range from about 4 to about 10 μm, and specifically, from about 6 to about 8 μm.

A toner of the present embodiment can be prepared using the method described above.

An imaging method in the present embodiment in which a toner is attached to a surface of a photoreceptor on which an electrostatic image is formed so as to form a visible image and the visible image is transferred to a transferring sheet. The method according to the present embodiment includes the toner that has the core-micro cylinder structure obtained using the method according to the present embodiment and the core is formed of a polyester resin and the micro cylinder is formed of a vinyl-based resin.

In general, an electrophotographic imaging process includes several processes required to form an image on a receiver, including a charging process, an exposing process, a developing process, a transferring process, a fixing process, a cleaning process, and an erasing process.

In the charging process, conventionally, a photoreceptor is covered with a charge having a desired polarity, such as a negative charge or a positive charge, by a corona or a charging roller. In the exposing process, an optical system, such as a laser scanner or a diode arrangement, selectively discharges the charged surface of the photoreceptor in an imagewise manner that the discharging occurs corresponding to an objective image to be formed on a final image receptor. Hereinafter, the term "light" is used to refer to any form of electromagnetic radiation such as ultraviolet radiation, visible right, and ultraviolet radiation.

In the developing process, in general, toner particles which have an appropriate polarity are contacted to the latent image on the photoreceptor using an electrically-biased developer having the same potential to the polarity of toner particles. Toner particles move to the photoreceptor and are selectively attached to the latent image by an electrostatic force to form a toner image on the photoreceptor.

In the transferring process, the toner image is transferred from the photoreceptor to the final image receptor. In some cases, an intermediate transferring element can be used together with a subsequent transferring process of the toner image from the photoreceptor to affect the transferring process of the toner image to the final image receptor.

In the fixing process, the toner image on the final image receptor is heated so that toner particles are softened or melted to fix the toner image onto the final image receiver. Alternatively, the toner can be fixed to the final image receiver under high pressure with or without heating. In the cleaning process, a residual toner on the photoreceptor is removed. Finally, in the erasing process, the charge on the photoreceptor is exposed to light having a predetermined wavelength band so that the charge on the photoreceptor is substantially, and uniformly drops to a low level. As a result, the residual latent image is removed so that the photoreceptor is prepared for a subsequent image forming cycle.

An imaging apparatus of the present embodiment includes an organic photoreceptor, a unit to charge a surface of the organic photoreceptor, a unit to form an electrostatic image on the surface of the organic photoreceptor, a unit to receive a toner, a unit to provide the toner to develop the latent image at the surface of the organic photoreceptor so as to develop the toner image, and a unit to transfer the toner image from the surface of the photoreceptor to a transferring sheet, in which the imaging apparatus uses the toner obtained using the method according to the present embodiment which has a core-shell structure, in which the core is formed of a polyester resin and the shell is formed of a vinyl-based resin.

Figure 3:
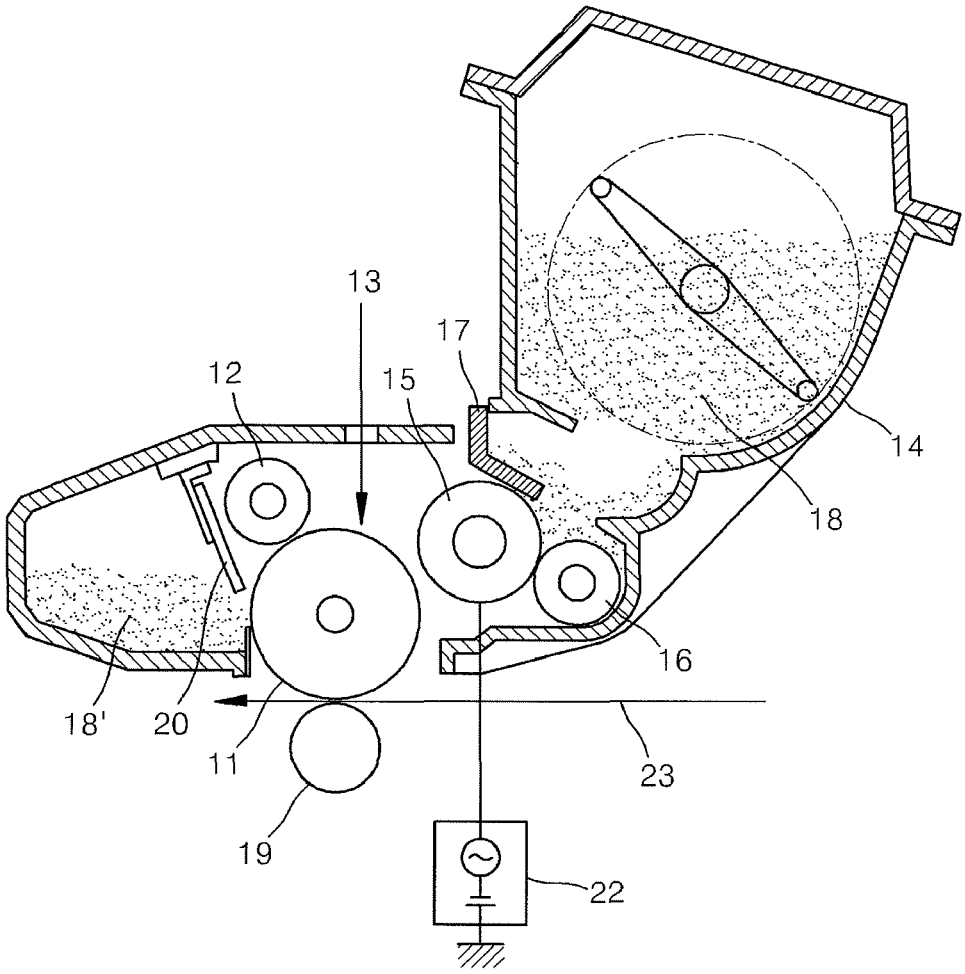
FIG. 3 is a view illustrating an imaging apparatus including a toner according to an embodiment of the present general inventive concept.

FIG. 3 is a view of a non-contact development type imaging apparatus including a toner prepared using a method according to an embodiment of the present general inventive concept.

A developing agent 18 which includes a nonmagnetic one component of a developer 14 is supplied to a developing roller 15 by a supply roller 16 formed of an elastic material, such as polyurethane foam or sponge. The developing agent 18 supplied to the developing roller 15 reaches a contact portion between a developer controlling blade 17 and the developing roller 15 due to rotation of the developing roller 15. The developer controlling blade 17 may be formed of an elastic material, such as metal or rubber. When the developing agent 18 passes through the contact portion between the developer controlling blade 17 and the developing roller 15, the developing agent 18 is controlled and formed into a thin layer which has a uniform thickness and is sufficiently charged. The developing agent 18 which has been formed into a thin layer is transferred to a development region of a photoreceptor 11 that is a latent image receptor, in which a latent image is developed by the developing roller 15. At this time, the latent image is formed by scanning light 13 to the photoreceptor 11.

The developing roller 15 is separated from the photoreceptor 11 by a predetermined distance and faces the photoreceptor 11. The developing roller 15 rotates in a clockwise direction, and the photoreceptor 11 rotates an anti-clockwise direction.

The developing agent 18 which has been transferred to the development region of the photoreceptor 11 develops the latent image formed on the photoreceptor 11 by an electric force generated by a potential difference between a DC bias AC voltage applied to the developing roller 15 and a latent potential of the photoreceptor 11 charged with a charging unit 12 so as to form a toner image.

The developing agent 18 which has been transferred to the photoreceptor 11 reaches a transferring unit 19 due to the rotation direction of the photoreceptor 11. The developing agent 18 which has been transferred to the photoreceptor 11 is transferred to a print sheet 23 to form an image by the transferring unit 19 having a roller shape applied with a high voltage having a polarity against the developing agent 18, or by corona discharging when the print sheet 23 passes through.

The image transferred to the print sheet 23 passes through a high temperature and high pressure fixing device (not illustrated) and thus the developing agent 18 is fused to the print sheet to form the image. Meanwhile, a non-developed, residual developing agent 18' on the developing roller 15 is collected by a supply roller 16 to contact the developing roller 15, and a non-developed, residual developing agent 18' on the photoreceptor 11 is collected by a cleaning blade 20. The processes described above are repeated.

Various embodiments of the present general inventive concept will be described in further detail with reference to the following examples. These examples are for illustrative purposes only and are not intended to limit the scope of the present general inventive concept.

EXAMPLE 1

—Preparation of Core Forming Molten Product—

100 parts by weight of polyester (produced by Samyang Co., Ltd) which has a glass transition temperature (Tg) of 64° C., a softening temperature (Ts) of 95° C., a Gel content of 7%, a number average molecular weight (Mn) of 5,000, and a molecular weight distribution (MWD) of 12, 3 parts by weight of carnauba wax, 1 part by weight of a Fe-based charge controller (T-77; Hodogaya), and 2 parts by weight of carbon black (Mogul-L, Cabot) were pre-mixed using a Henschel mixer for 10 minutes, and then the pre-mixture was injected to a hopper of a first extruder to form a core.

—Preparation of Micro Cylinder Forming Molten Product—

100 parts by weight of poly styrene-butylacrylate that is a vinyl-based resin which has a glass transition temperature (Tg) of 58° C., a softening temperature (Ts) of 110° C., a Gel content of 1%, a number average molecular weight (Mn) of 5229, a molecular weight distribution (MWD) of 8, and 1 part by weight of carbon black were pre-mixed using a Henschel mixer for 10 minutes, and then the pre mixture was injected to a second extruder to form a micro cylinder.

—Double Extrusion—

Referring to FIGS. 1 and 2, first and second extruders 1 and 2 used were extruder modular co-rotating twin screw extruders each including two kneading blocks. The first extruder 1 extruded a core at a supply speed of 1.5 kg/hr at a screw speed of 150 rpm at a temperature inside the first extruder from 120 to 125° C. The second extruder 2 extruded a micro cylinder at a supply speed of 1.8 kg/hr, at a screw speed of 150 rpm, at a temperature inside the second extruder 2 in a range from 110 to 115° C. The core and the micro cylinder were extruded at a same time through a double extrusion capillary die. As a result, a core-micro cylinder 4 structure in which a core was inserted in the micro cylinder was obtained.

Referring to FIGS. 1 and 2, a portion of the double extrusion capillary die connected to the first extruder 1 thickness a is 9.8 μm and a portion of the double extrusion capillary die connected to the second extruder 2 thickness b is 10 μm. As a result, the micro cylinder forming molten product B was extruded to a thickness b' of 0.1 μm.

—Milling Process—

Subsequently, the core-micro cylinder 4 was sorted into large particles through a cooling process, milled using a Bantam Mill to a particle size from 1 to 2 mm, and then milled using a miller SR-15 and a classifier TR-15 to a particle size of a few μm. Then, the obtained particles were classified to be of a size from 6 to 8 μm.

—External Layer Coating Process—

1.0 part by weight of large silica, 1.0 part by weight of small silica, 0.1 parts by weight of $TiO_2$, 0.1 parts by weight of melamine-based polymer beads were mixed with 180 parts by weight of the milled core-micro cylinder at 3800 rpm for 5 minutes to prepare a hybrid toner according to an embodiment of the present general inventive concept.

EXAMPLE 2

A hybrid toner was prepared in a same manner as in Example 1, except that 3 parts by weight of polypropylene wax was used instead of carnauba wax, and 1 part by weight of a Zn-based charge controller (E84-S, ORIENETAL CHEMICAL) was used instead of a Fe-based charge controller (T-77, HODOGAYA).

EXAMPLE 3

A hybrid toner was prepared in a same manner as in Example 1, except that 3 parts by weight of polyester wax (product name: WE-5, produced by NOF Co.) was used instead of carnauba wax.

Each of the hybrid toners having the core-micro cylinder 4 structure prepared according to Examples 1 to 3 was loaded into a developer and then tested using contact and non-contact development type printers. As a result, even when 5000 sheets were printed, high quality images having excellent durability and fixability were able to be obtained.

Figure 4:
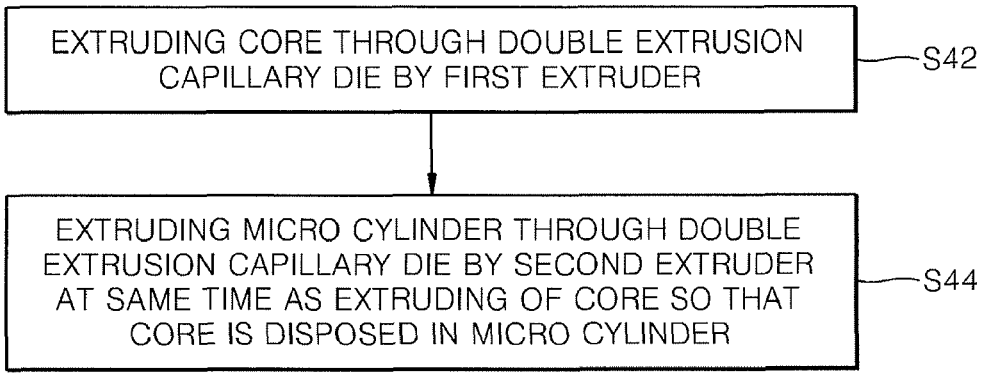
FIG. 4 is a flowchart illustrating an apparatus to prepare a hybrid toner in an embodiment of the present general inventive concept.

FIG. 4 is a flowchart illustrating an apparatus to prepare a hybrid toner in an embodiment of the present general inventive concept. Referring to FIGS. 1 and 4, in operation S42, a core is extruded through a double extrusion capillary die 3 by a first extruder 1. In operation S44, a micro cylinder is extruded through the double extrusion capillary die 3 by a second extruder 2 at a same time as the extruding of the core so that the core is disposed in the micro cylinder.

A hybrid toner having a core-micro cylinder structure of the present embodiment consists of a core formed of a polyester-based resin and a shell formed of a vinyl-based resin. The hybrid toner can retain utilities of the polyester-based resin and the vinyl-based resin, and at a same time, a toner blocking a phenomenon, image contamination, and low storage stability which occur due to dispersion of wax and colorants which are dispersed from a polyester-based resin that forms a core to an outer surface of the toner can be controlled and improved.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A hybrid toner, comprising:

a micro cylinder; a core inserted into the micro cylinder; and an external addition layer covering the micro cylinder into which the core is inserted.

2. The hybrid toner of claim 1, wherein the core comprises:

100 parts by weight of a polyester-based resin, 1 to 20 parts by weight of wax, 0.1 to 10 parts by weight of a colorant, and 0.1 to 10 parts by weight of a charge controller; the micro cylinder comprises 5 to 500 parts by weight of vinyl-based resin and 0.1 to 10 parts by weight of a colorant; and the external addition layer comprises 0.1 to 10 parts by weight of silica, 0.1 to 5 parts by weight of metal oxide, and 0.1 to 10 parts by weight of polymer beads.

3. The hybrid toner of claim 1, wherein the polyester-based resin has a number average molecular weight from 1,000 to 120,000 and a softening point from 90° C. to 150° C.

4. The hybrid toner of claim 2, wherein the wax has a melting point from 50° C. to 150° C.

5. The hybrid toner of claim 2, wherein the colorant is selected from the group consisting of carbon black, aniline black, yellow colorant, magenta colorant, and cyan colorant.

6. The hybrid toner of claim 2, wherein the vinyl-based resin comprises:

a polymer containing one or more repeating unit selected from the group consisting of a styrene-based repeating unit, such as styrene, vinyltoluene, or α-methylstyrene; (meth)acrylate-based repeating unit, such as (meth) acrylate, methyl(meth)acrylate, ethyl(meth)acrylate, propyl(meth)acrylate, butyl(meth)acrylate, 2-ethylhexyl(meth)acrylate, dimethylaminoethyl(meth)acrylate, (meth)acrylonitrile, or (meth)acrylamide; an ethylene unsaturated monoolefine-based repeating unit, such as ethylene, propylene, or butylene; a vinyl halide-based repeating unit, such as vinyl chloride, vinylidene chloride, or vinyl fluoride; a vinylester-based repeating unit, such as vinyl acetic acid or vinyl propionic acid; a vinylether-based repeating unit, such as vinylmethylether or vinylethylether; a vinylketone-based repeating unit, such as vinylmethylketone or methylisopropheylketone; and a nitrogen-containing vinyl-based repeating unit, such as 2-vinylpyridine, 4-vinylpyridine, or N-vinylpyrrolidone, or a mixture of two types of the respective polymers.

7. The hybrid toner of claim 2, wherein the silica comprises:

large silica particles having a size in a range from 30 to 200 nm and small silica particles having a size in a range from 5 to 20 nm.

8. The hybrid toner of claim 2, wherein the metal oxide is $TiO_2$.

9. The hybrid toner of claim 2, wherein the polymer beads comprises:

at least one selected from the group consisting of a spherical styrene-based resin, a spherical methyl methacrylic acid, a spherical styrene-methyl methacrylic acid copolymer, an spherical acryl-based resin, and an spherical acryl-styrene copolymer.

10. The hybrid toner of claim 1, wherein an average diameter of the hybrid toner is in a range from 4.0 to 12.0 μm.

11. A method of preparing a hybrid toner, the method comprising:

melting and mixing a vinyl-based resin and a colorant to prepare a micro cylinder forming molten product;

melting and mixing a polyester-based resin, wax, a colorant, and a charge controller to prepare a core forming molten product which is to be inserted to micro cylinders to be formed from the micro cylinder forming molten product;

extruding the micro cylinder forming molten product and the core forming molten product through a double extrusion micro-capillary die at a same time to prepare a core-micro cylinder in which a core is inserted in the micro cylinder;

milling the core-micro cylinder; and covering the milled core-micro cylinder with an external addition layer comprising silica, metal oxide, and a polymer bead.

12. An imaging method, comprising:

forming a viable image by attaching a hybrid toner to a surface of a photoreceptor on which a latent image is formed; and transferring the visible image onto a transferring sheet; and wherein the hybrid toner includes a micro cylinder, a core inserted into the micro cylinder and an external addition layer covering the micro cylinder into which the core is inserted.

13. An imaging apparatus comprising:

an organic photoreceptor;

a unit to charge a surface of the organic photoreceptor;

a unit to form a latent image on the surface of the organic photoreceptor;

a unit to receive a hybrid toner;

a unit to supply the hybrid toner to develop the latent image formed on the surface of the organic photoreceptor so as to develop the toner image; and a unit to transfer the toner image from the surface of the photoreceptor to the transferring sheet; and wherein the hybrid toner includes a micro cylinder, a core inserted into the micro cylinder and an external addition layer covering the micro cylinder into which the core is inserted.

14. A method to prepare a hybrid toner, the method comprising:

extruding a core through a double extrusion capillary die by a first extruder; and extruding a micro cylinder through the double extrusion capillary die by a second extruder at a same time as the extruding of the core so that the core is disposed in the micro cylinder.

* * * * *